US011905941B2

(12) United States Patent
Coffey et al.

(10) Patent No.: US 11,905,941 B2
(45) Date of Patent: Feb. 20, 2024

(54) SEWAGE BASIN PUMP CONTROL SUPPORT

(71) Applicant: FRANKLIN ELECTRIC CO., INC., Fort Wayne, IN (US)

(72) Inventors: James J. Coffey, Oklahoma City, OK (US); Petr Sramek, Moore, OK (US); Steven C. Gray, Tuttle, OK (US)

(73) Assignee: FRANKLIN ELECTRIC CO., INC., Fort Wayne, IN (US)

( * ) Notice: Subject to any disclaimer, the term of this patent is extended or adjusted under 35 U.S.C. 154(b) by 0 days.

(21) Appl. No.: 17/558,136

(22) Filed: Dec. 21, 2021

(65) Prior Publication Data

US 2022/0112891 A1 Apr. 14, 2022

Related U.S. Application Data

(62) Division of application No. 15/853,360, filed on Dec. 22, 2017, now Pat. No. 11,208,992.

(51) Int. Cl.
*F04B 43/00* (2006.01)
*F04B 49/04* (2006.01)
(Continued)

(52) U.S. Cl.
CPC ..... *F04B 43/0081* (2013.01); *E03F 5/22* (2013.01); *F04B 15/02* (2013.01); *F04B 23/021* (2013.01); *F04B 49/04* (2013.01); *F04B 49/025* (2013.01)

(58) Field of Classification Search
CPC .... F04B 43/0081; F04B 49/025; F04B 49/04; F04B 15/02; F04B 23/021; F04B 19/04; F04B 39/14; F04B 53/22
See application file for complete search history.

(56) References Cited

U.S. PATENT DOCUMENTS 553,794 A 1/1896 Thatcher
1,498,245 A 6/1924 May
(Continued)

FOREIGN PATENT DOCUMENTS

CA 581 437 8/1959
CA 719 464 10/1965
(Continued)

OTHER PUBLICATIONS

Wikipedia; Float switch—Wikipedia from en.wikipedia.org/wiki/Float_switch (Year: 2022).*
(Continued)

*Primary Examiner* — Kenneth J Hansen
*Assistant Examiner* — David N Brandt
(74) *Attorney, Agent, or Firm* — Faegre Drinker Biddle & Reath LLP

(57) ABSTRACT

A wastewater sump assembly for receiving and disposing of undesired fluid and, in some cases, solid waste (collectively "wastewater"). A sump basin includes an upstanding wall a base and a top. A sensor in the form, e.g., of a float switch extends into the basin and is operable to actuate a pump to remove collective wastewater from the basin. The sensor depends from a sensor support that is supported distally within the basin in a vertical manner and is supported proximately within the basin in a horizontal manner, with securement of the sensor support not requiring traversal of the basin top and with the distal basin support not needing to be accessed vertically through a pump access aperture in the top.

10 Claims, 10 Drawing Sheets

(51) Int. Cl.

| | |
|---|---|
| ***E03F 5/22*** | (2006.01) |
| ***F04B 15/02*** | (2006.01) |
| ***F04B 23/02*** | (2006.01) |
| ***F04B 49/025*** | (2006.01) |

(56) References Cited

U.S. PATENT DOCUMENTS

| | | | | |
|---|---|---|---|---|
| 1,947,140 | A | | 2/1934 | Rollason |
| 2,240,880 | A | | 5/1941 | Bennett |
| 2,254,168 | A | | 8/1941 | Dale |
| 2,488,506 | A | | 11/1949 | Bernhardt |
| 2,531,752 | A | | 11/1950 | Thomas |
| 2,701,529 | A | | 2/1955 | Finzel |
| 2,834,845 | A | | 5/1958 | Nielsen |
| 2,922,854 | A | | 1/1960 | Nielsen |
| 2,935,029 | A | | 5/1960 | Miles |
| 3,162,737 | A | | 12/1964 | Tutthill |
| 3,198,125 | A | | 8/1965 | Yuza et al. |
| 3,256,822 | A | | 6/1966 | McHenry |
| 3,307,000 | A | | 2/1967 | Ekey |
| 3,373,896 | A | | 3/1968 | Davis |
| 3,442,219 | A | * | 5/1969 | Fitzgerald ..... F04B 49/04 417/40 |
| 3,474,843 | A | | 10/1969 | Maris |
| 3,656,866 | A | | 4/1972 | Hine, Jr. et al. |
| 3,667,692 | A | | 6/1972 | Grace |
| 3,726,606 | A | | 4/1973 | Peters |
| 3,784,772 | A | | 1/1974 | Nelson |
| 3,794,789 | A | | 2/1974 | Bynum |
| 3,897,172 | A | * | 7/1975 | Hall ..... F04B 49/025 417/40 |
| 3,916,130 | A | | 10/1975 | Cade |
| 3,954,178 | A | | 5/1976 | Mason, Jr. |
| 3,992,130 | A | | 11/1976 | Childress |
| 4,001,533 | A | * | 1/1977 | Conery ..... H01H 35/18 200/84 C |
| 4,228,427 | A | | 10/1980 | Niedermeyer |
| 4,275,815 | A | | 6/1981 | Davis |
| 4,344,543 | A | | 8/1982 | Hoffman |
| 4,513,875 | A | | 4/1985 | Kuehn, Sr. |
| 4,627,537 | A | | 12/1986 | Rogers |
| 4,832,227 | A | | 5/1989 | Hoffman |
| 4,890,425 | A | | 1/1990 | Mamula |
| 5,100,298 | A | | 3/1992 | Shibata et al. |
| 5,217,142 | A | | 6/1993 | Schutz |
| 5,226,558 | A | | 7/1993 | Whitney et al. |
| 5,324,171 | A | | 6/1994 | Cook |
| 5,361,906 | A | | 11/1994 | Sterett |
| 5,383,558 | A | | 1/1995 | Wilkinson et al. |
| 5,535,910 | A | | 7/1996 | Cassel |
| 5,669,526 | A | | 9/1997 | Keyfauver |
| 5,799,792 | A | | 9/1998 | Abrums |
| 5,886,266 | A | | 3/1999 | Stiller et al. |
| 5,924,846 | A | | 7/1999 | Arnold, Jr. et al. |
| 6,059,208 | A | | 5/2000 | Struthers |
| 6,164,315 | A | | 12/2000 | Haslock et al. |
| 6,273,291 | B1 | | 8/2001 | Conti |
| 6,276,093 | B1 | | 8/2001 | Janesky |
| 6,305,410 | B1 | | 10/2001 | Cook et al. |
| 6,322,326 | B1 | | 11/2001 | Davis et al. |
| 6,348,657 | B1 | | 2/2002 | Haslock et al. |
| 6,375,430 | B1 | | 4/2002 | Eckert et al. |
| 6,420,668 | B1 | | 7/2002 | Lee |
| 6,430,757 | B1 | | 8/2002 | Pohler |
| 6,464,531 | B2 | | 10/2002 | Eckert et al. |
| 6,555,754 | B2 | | 4/2003 | Gilmour |
| 6,772,782 | B2 | | 8/2004 | Bogan et al. |
| D500,770 | S | | 1/2005 | Pohler |
| 6,854,479 | B2 | | 2/2005 | Harwood |
| 6,867,383 | B1 | | 3/2005 | Currier |
| 6,953,302 | B1 | | 10/2005 | Kochling |
| D523,517 | S | | 6/2006 | Flick |
| 7,100,632 | B2 | | 9/2006 | Harwood |
| 7,264,449 | B1 | | 9/2007 | Harned et al. |
| 7,520,736 | B2 | | 4/2009 | Pohler |
| 7,563,082 | B2 | | 7/2009 | Pohler |
| 7,578,657 | B2 | | 8/2009 | Kowalak et al. |
| 7,712,259 | B1 | | 5/2010 | Pettesch |
| 7,832,586 | B2 | | 11/2010 | Vovan |
| 7,855,345 | B2 | | 12/2010 | Stevens et al. |
| 8,523,532 | B1 | | 9/2013 | Pohler |
| 2004/0231247 | A1 | | 11/2004 | Thachenkery |
| 2005/0034383 | A1 | | 2/2005 | Allen |
| 2006/0272203 | A1 | | 12/2006 | Weber |
| 2007/0284276 | A1 | | 12/2007 | Luttik et al. |
| 2008/0000795 | A1 | | 1/2008 | Deakin et al. |
| 2009/0129940 | A1 | | 5/2009 | Stevens et al. |
| 2010/0236966 | A1 | | 9/2010 | Luttik et al. |
| 2012/0085688 | A1 | | 4/2012 | Schmidt et al. |
| 2012/0107137 | A1 | | 5/2012 | Early et al. |
| 2014/0271126 | A1 | | 9/2014 | Gray et al. |
| 2019/0195215 | A1 | | 6/2019 | Coffey et al. |

FOREIGN PATENT DOCUMENTS

| | | | |
|---|---|---|---|
| CA | 766 515 | | 9/1967 |
| CA | 783 945 | | 4/1968 |
| CA | 785 887 | | 5/1968 |
| CA | 945 417 | | 4/1974 |
| CA | 1034676 | | 7/1978 |
| CA | 1052458 | | 4/1979 |
| CA | 2 344 083 | | 4/2001 |
| CA | 2 162 371 | | 7/2001 |
| EP | 0 619 431 | A1 | 10/1994 |
| EP | 1 471 037 | | 10/2004 |
| WO | 2006/017448 | | 2/2006 |

OTHER PUBLICATIONS

Dab, Polypump.Com. "Fekabox 100", website—http://bigspace.celerity.co.uk/polypump/dab_fekabox100_pdf, 2007.

Dab, Polypump.Com "Fekabox 200", website—http://bigspace.celerity.co.uk/polypump/dab_fekabox200_pdf, 2007.

Dab, Polypump.Com "Fekabox 280", website—http://bigspace.celerity.co.uk/polypump/dab_fekabox280_pdf, 2007.

Franklin Electric Co., Inc., "Little Giant 14S-CIM, 16S-CIM, 14EH-CIM and 16EH-CIM", http://littlegiant.com/media/131347/993302.pdf, Instruction Manual, May 4, 2010.

Franklin Electric Co., Inc., "Submersible Effluent & Sewage Pumps WS Series", http://littlegiant.com/media/131392/200499_WS.pdf, Aug. 24, 2010.

Franklin Electric Co., Inc., "Little Giant Sewage Accessories", Manual, http://littlegiant.com/media/131661/998127.pdf, Dec. 2007.

Franklin Electric Co., Inc., "Little Giant Sewage Pump Replacement Parts Manual", http://littlegiant.com/media/131717/993467.pdf, Mar. 3, 2009.

Orenco Systems Inc., "Pump Basin with Effluent, Sewage or Grinder Pump", Sep. 8, 1993.

Crane Pumps and Systems, "Packaged Sewage Systems", http://www.cranepumps.com/downloadables/brochures/BPPPKGSYS.pdf, 2015.

Jackel, Sump Basin Cover, Part No. SF60914-S, http://www.jackelinc.com/pdf/SF60914-S%20Product%20Sheet.pdf, Jan. 2014.

Jackel, "Sump Basin Cover, Part No. SF60915-P", http://www.jackelinc.com/pdf/SF60915-P%20Product%20Sheet.pdf, Jan. 2014.

Topp Industries, Inc., "2017 Product Catalog", http://www.toppindustries.com/upload/documents/topp_2017_product_catalog_website_secure.pdf, Jan. 2017.

FPS Engineered Products, "V4 Powersewer", 6 pages, Sep. 2017.

Power Sewer Retro Fit, "998357 Conversion to Floats Instruction Manual", Mar. 7, 2005.

Orenco Systems Inc., "Sample Effluent Pumping Packages", 2001.

* cited by examiner

SEWAGE BASIN PUMP CONTROL SUPPORT

CROSS-REFERENCE TO RELATED APPLICATION(S)

This application is a divisional of U.S. patent application Ser. No. 15/853,360 filed on Dec. 22, 2017, the disclosure of which is hereby incorporated herein in its entirety.

BACKGROUND

1. Technical Field

The present disclosure relates to a wastewater sump assembly for receiving and disposing of undesired fluid and, in some cases, solid waste.

BACKGROUND/SUMMARY

Buried sumps are utilized to collect and retain undesired liquid and, in some cases, solid waste. The unwanted material (generally referred to as "wastewater") is collected in the sump for later pumping to, for example, an appropriate sewage treatment system such as a city sewer or septic tank. Such devices have particular applicability in instances where sewage cannot flow via gravity to a septic tank or a municipal sewage system. In these cases, the sewage must be pumped to such systems. For example, many residential homes have finished basements including bathrooms which are situated below grade. In such installations, bathroom waste can travel via a gravity flow to a buried sump having a submersible pump useful for periodically removing such waste as the sump reaches a predetermined level of collected wastewater.

Typically, the sump will include an inlet formed through a sidewall and receiving the wastewater to be removed. A submersible pump will be housed in the sump and include an actuator such as a float switch which actuates the submersible pump at a defined collection level. A pump outlet can be positioned through the top or sidewall of the sump and fluidly connected to the submersible pump such that the submersible pump discharges the sump contents through the outlet.

The sump is typically buried and can be cemented in place in the foundation of, for example, a residence. Sumps can also be buried in locations remote from the source of the wastewater. To provide access to the sump for servicing and/or replacement of the pump and/or pump switch, a detachable lid is selectively securable to the top of the sump.

The pump switch can be positioned through an aperture formed in a detachable lid, or through an aperture in the floor of a dry well positioned at the top of the basin, as in U.S. Pat. No. 6,059,208, titled BURIED PLASTIC SEWAGE SUMP, the entire disclosure of which is hereby explicitly incorporated by reference herein. Elements of the sewage sump assembly disclosed in U.S. Pat. No. 6,059,208 can be utilized in conjunction with or in lieu of elements of the sewage sump assembly of the present disclosure. Alternatively, the pump switch can be positioned through a dedicated pump switch aperture such as the one disclosed in U.S. Patent Application Publication No. 2014/0271126, the entire disclosure of which is hereby explicitly incorporated by reference herein. Elements of the sewage sump assembly disclosed in U.S. Patent Application Publication No. 2014/0271126 can be utilized in conjunction with or in lieu of elements of the sewage sump assembly of the present disclosure. U.S. Pat. No. 6,059,208 features a top that is integral and monolithic with the upstanding wall of the basin in the form of a drywell defining top. U.S. Patent Application Publication No. 2014/0271126 similarly features an integral, monolithic top, but such top does not define a drywell. The features of the present disclosure can be incorporated into either of these arrangements, for example.

The present disclosure relates to a wastewater sump assembly for receiving and disposing of undesired fluid and, in some cases, solid waste. Exemplary embodiments of the present disclosure include a sump basin having a base, an upstanding wall and a top extending inwardly from the upstanding wall. The base, upstanding wall, and top can be formed of a single, integral, monolithic material so that no seams are presented between the base and the upstanding wall and no seams are presented between the upstanding wall and the top. Additional tops in the form of detachable lids can be provided to close and seal apertures through the integral top. A sensor in the form of a float switch, for example, extends into the basin and is operable to actuate a pump to remove collected wastewater from the basin. A sensor such as a float switch can depend from a sensor support. In accordance with the present disclosure, the sensor support is supported distally within the basin in a vertical manner and is supported proximally within the basin in a horizontal manner.

The disclosure, in one form thereof provides a wastewater sump, including: a basin including a base; an upstanding wall extending upwardly from the base and, together with the base, defining an interior volume of the basin; an opening opposite the base; a distal basin support; and a proximal basin support. In this form of the disclosure, the basin includes a wastewater inlet and a wastewater outlet, and is sized to receive a submersible pump. A pump control is sized for insertion into the basin through the opening, the pump control comprising: a sensor; a sensor support comprising a distal sensor support and a proximal sensor support, the sensor secured to the sensor support; the distal sensor support engageable with the distal basin support to vertically support the pump control above the base of the basin while allowing a rotation of the pump control about an axis twice intersecting the upstanding wall of the basin, wherein, with the distal sensor support engaging the distal basin support, the sensor support can rotate relative to the distal basin support into abutment with the upstanding wall, the proximal sensor support engageable with the proximal basin support to horizontally support the pump control within the interior volume, engagement of the proximal sensor support with the proximal basin support resisting the rotation, whereby, with the distal sensor support engaging the distal basin support and the proximal sensor support engaging the proximal basin support, the sensor cannot rotate relative to the distal basin support into abutment with the upstanding wall.

In another form thereof, the present disclosure provides a wastewater sump, comprising: a basin comprising: a base; an upstanding wall extending upwardly from the base and, together with the base, defining an interior volume of the basin; and a top extending inwardly from the upstanding wall, the top defining a pump aperture sized to allow passage of a submersible pump into the interior volume of the basin; a distal basin support, the distal basin support positioned vertically under the top of the basin and vertically covered by the top, whereby the distal basin support is not accessible vertically through the top; a pump control engageable with the distal basin support, with the pump control engaging the distal basin support, the pump control supported above the base.

In another form thereof, the present disclosure provides a pump control comprising: a sensor operable to communicate a level of wastewater in a container to a pump; a sensor support, the sensor secured to the sensor support, the sensor support comprising: a longitudinal extension having a longitudinal axis; a distal sensor support extending radially outward from the longitudinal extension relative to the longitudinal axis of the longitudinal extension; and a proximal sensor support comprising an extension extending axially along the longitudinal axis, the extension having a terminal end axially moveable along the longitudinal axis relative to the longitudinal extension.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Figure 1:
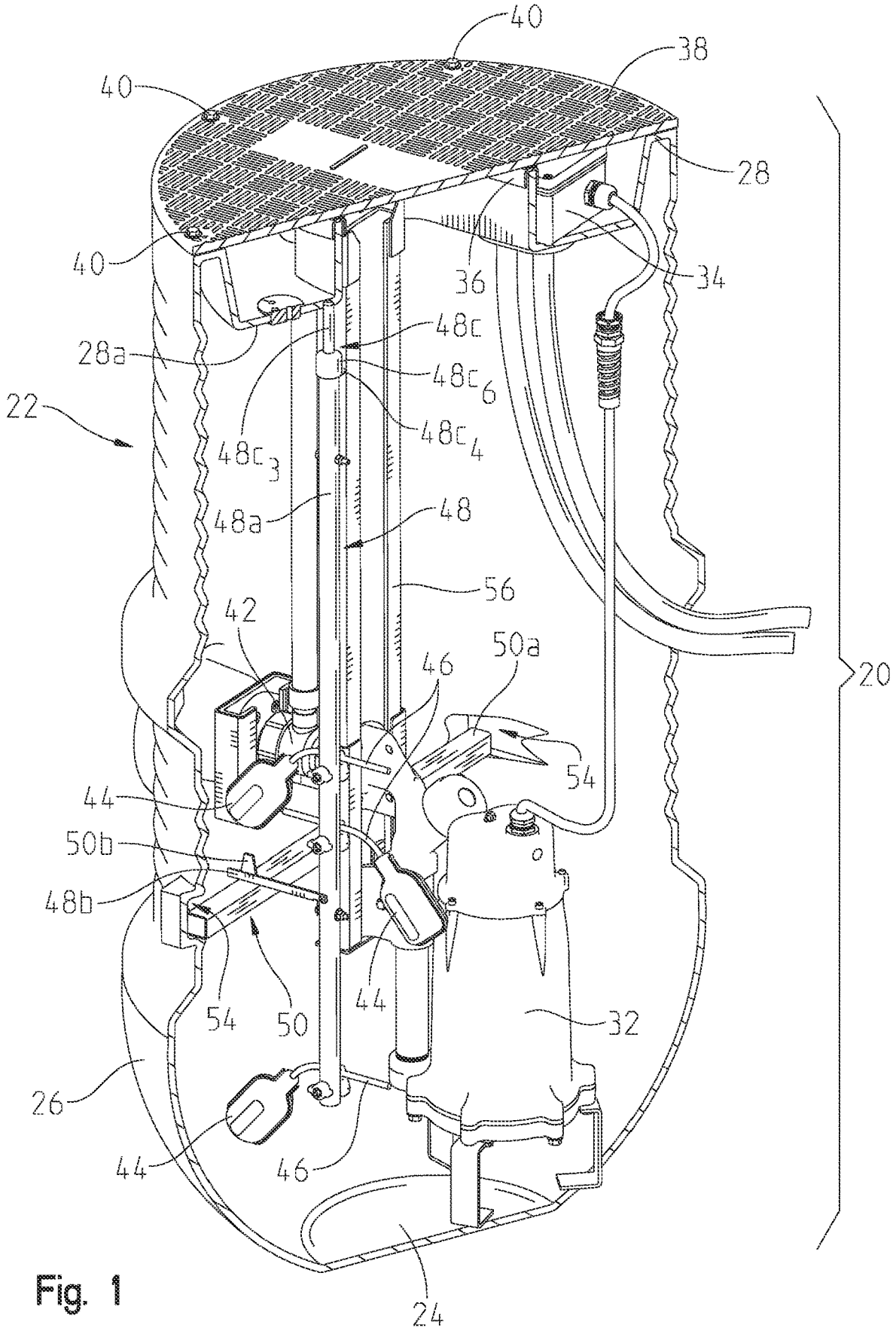
FIG. 1 is a perspective, partial sectional view of a wastewater sump assembly in accordance with the present disclosure.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DETAILED DESCRIPTION

For the purposes of promoting an understanding of the principles of the present disclosure, reference is now made to the embodiment illustrated in the drawings, which are described below. The embodiment disclosed below is not intended to be exhaustive or limit the present disclosure to the precise form disclosed in the following detailed description. Rather, the embodiment is chosen and described so that others skilled in the art may utilize its teachings. Therefore, no limitation of the scope of the present disclosure is thereby intended.

Referring to FIG. 1, sump assembly 20 includes basin 22 formed from base 24, upstanding wall 26 and top 28. As illustrated, upstanding wall 26 extends axially upwardly from base 24 and top 28 extends radially inwardly from upstanding wall 26. Basin 22 is a rotational molded (sometimes referred to as "roto molded") polyethylene basin, with an integral, monolithic material forming base 24, upstanding wall 26 and top 28. With base 24, upstanding wall 26 and top 28 roto molded to be formed from an integral, monolithic material, no seams are presented between base 24 and upstanding wall 26. Similarly, no seams are presented between upstanding wall 26 and top 28. Additional details of an exemplification of the present disclosure can be found in FPS V4 POWERSEWER™, which can be found at: http://www.franklinengineered.com/media/35175/996896_PowerSewer_Brochure.pdf, a copy of which is filed in an Information Disclosure Statement filed together with this patent application, the entire disclosure of which is hereby explicitly incorporated by reference herein.

Figure 6:
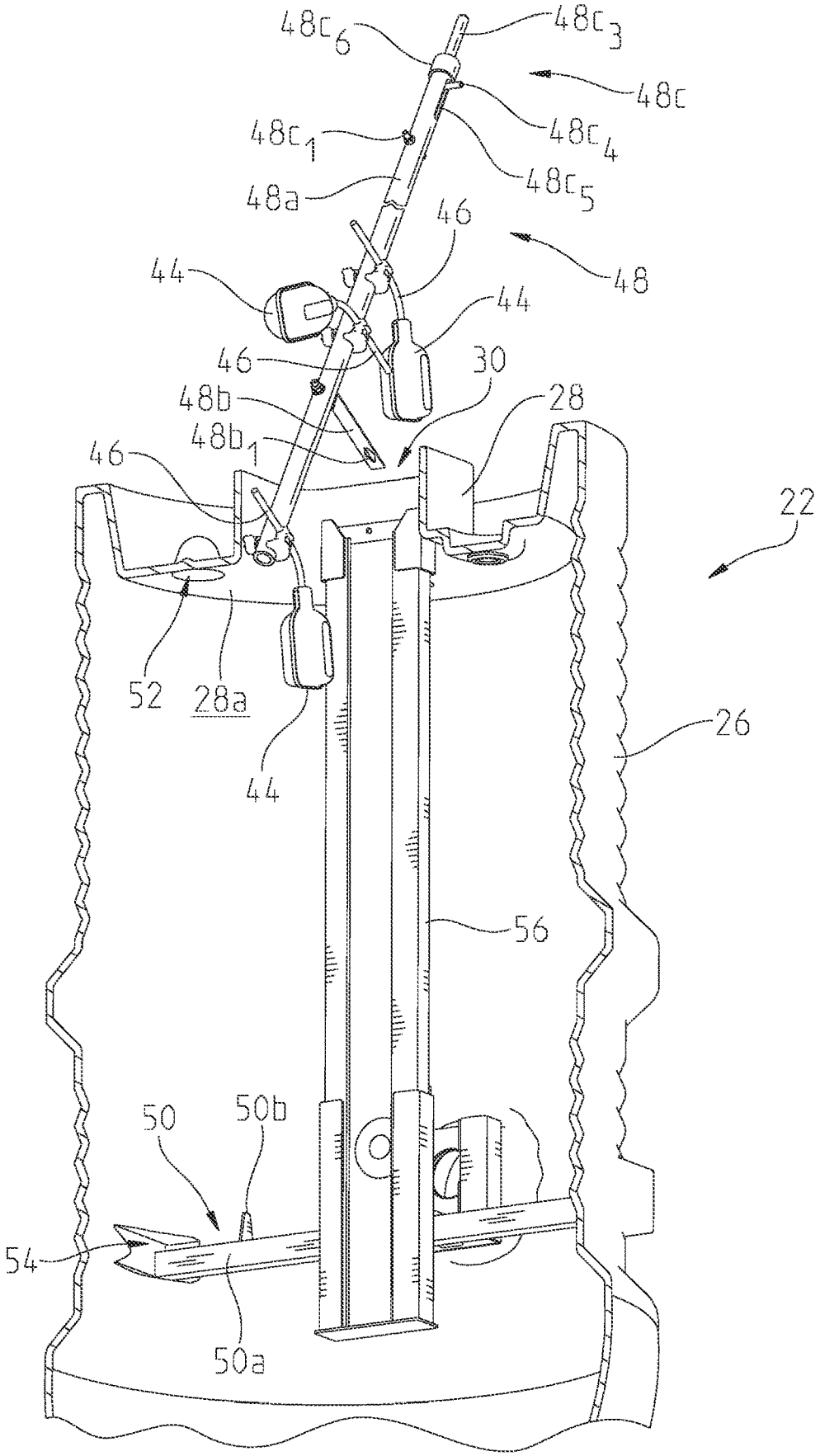
FIG. 6 is a perspective, partial sectional view of the wastewater sump assembly of FIG. 1, illustrating an initial step of inserting a pump control of the present disclosure into the wastewater assembly.

Top 28 extends from upstanding wall 26 inwardly until terminating at wet well opening 30 (FIG. 6). Wet well opening 30 defines a pump aperture sized to allow passage of submersible pump 32 into basin 22. Top 28 does not travel straight radially inwardly from upstanding wall 26 to wet well opening 30, but rather creates a depression forming a dry well. The dry well formed by top 28 may be occupied by electrical junction box 34, or elements of sump assembly 20 that, desirably, are not exposed to the contents of basin 22, or to the environment outside of sump assembly 20. Electrical junction box 34 and any other elements of sump assembly positioned in the dry well formed by top 28 are sealed from the contents of basin 22 by molded plastic lid 36 and are sealed from the environment outside of sump assembly 20 by molded nylon lid 38.

Molded plastic lid 36 is positioned atop the vertical wall of top 28 defining wet well opening 30 and molded nylon lid 38 is thereafter positioned atop molded plastic lid 36. In this position, with molded plastic lid 36 sandwiched between top 28 and molded nylon lid 38, molded nylon lid 38 is secured to basin 22 by bolts 40 spaced about the perimeter of basin 22. Typically, a rubber gasket will be positioned between basin 22 and molded nylon lid 38 to create a seal therebetween. The structures of basin 22 described to this point are the same as the corresponding structures found in U.S. Pat. No. 6,059,208 incorporated by reference above. While only a distal portion of molded plastic lid 36 is shown in FIG. 1, greater illustration of this element (in the form of molded plastic lid 13) can be found in U.S. Pat. No. 6,059,208.

In use, wastewater enters basin 22 through an inlet and collects in basin 22 until submersible pump 32 is energized to expel the contents of basin 22 through outlet 42. Submersible pump 32 may be a Franklin Electric model 9SN-CIM submersible pump, available from Franklin Electric, Co. of Fort Wayne, Indiana. The inlet to basin 22 can take the form of any pipe in fluid communication with the interior of basin 22. For example, an inlet such as inlet pipe 41 disclosed in U.S. Pat. No. 6,059,208 incorporated by reference above may be utilized. Submersible pump 32 is energized when a certain level of wastewater is sensed in basin 22. A sensor such as an ultrasonic level sensor, a pressure switch or float switch 44 may be utilized to signal that the level of wastewater in basin 22 is sufficiently high to require removal via submersible pump 32.

FIG. 1 illustrates three float switches 44. Any one of these float switches 44 may be used to energize submersible pump 32 to remove the contents of basin 22. In one embodiment, the proximal most float switch 44 can trigger an alarm indicating that the pump is not functioning properly. For the purposes of this document, proximal/distal references molded nylon lid 36 as the proximal most point of sump assembly 20 and base 24 as the distal most point of sump assembly 20. The intermediate float switch 44 may be a pump on switch indicating that the pump should be energized to begin removal of the contents of basin 22. In this exemplification, the distal most float switch 44 is a pump off switch indicating that the pump should no longer be energized and pumping should cease.

Each float switch 44 includes electric cord 46 extending therefrom. Each electric cord 46 is tethered to sensor support 48 such that the buoyancy of each float switch 44 on wastewater in basin 22 will cause a change in the attitude of float switch 44 to open or close an electric circuit depending on whether fluid in basin 22 is raising or lowering.

Float switches 44 may be Franklin Electric Model RFSN series float switches available from Franklin Electric Co., Inc. of Fort Wayne, Indiana Each of float switches 44 includes a float including a sphere positioned within a raceway and operable to open and close an electrical circuit in response to a change in attitude of the float, which causes a repositioning of the sphere. Electric cords 46 extending from and electrically connected to float switches 44 may terminate in electrical junction box 34, which includes a pump control capable of receiving inputs from float switches 44 to operate submersible pump 32. In alternative forms, electric cords may terminate in a piggyback plug having a male electrical connector for connection to a standard wall outlet and a female electrical connector for further connection to a subsequent male connector. With the piggyback plug connected to a wall outlet, float switches 44 are operable to selectively close an electric circuit through the piggyback plug to allow the passage of current therethrough.

Float switches 44 may be made in accordance with the disclosure of U.S. Pat. Nos. 5,087,801 and 5,142,108, the entire disclosures of which are both explicitly incorporated by reference herein. For example, each float 44 may include an internal ball which, with floats 44 positioned as illustrated in FIG. 1, with a distal end thereof pointed downwardly toward base 24 of basin 22, is incapable of closing the electric circuit. If the attitude of a float switch 44 is changed such that the distal end thereof points upwardly toward top 28 of basin 22, then the internal ball will actuate to electrically close the electrical circuit. Float switches 44 are "sensors" in that they incorporate a trigger point (i.e., the point at which the circuit is closed) sensing and signaling a certain level of wastewater in basin 22.

Float switches 44 are suspended from sensor support 48 at the desired height in basin 22 and with the desired length of electric cord 46 spanning each float switch and sensor support 48. A clamp is utilized to secure each electric cord 46 to sensor support 48. In prior configurations, including those disclosed in U.S. Pat. No. 6,059,208, the sensor support was positioned through an aperture formed in the floor of the dry well, thereby creating an additional leak point requiring sealing. In the present disclosure, sensor support 48 incorporates distal sensor support 48*b* which cooperates with distal basin support 50 to support sensor support 48 and the float switches 44 tethered thereto vertically above base 24 of basin 22.

It is important to position float switches 44 in basin 22 such that float switches 44 can articulate between their distal most positions in basin 22 to their proximal most positions without encountering static structures in basin 22, including submersible pump 32, piping, support structures, etc. Utilizing a structure vertically accessible through wet well opening 30 to support sensor support 48 creates difficulty in positioning float switches 44 in operable and unobstructed positions. Therefore, the distal basin support of the present disclosure is offset from vertical alignment with wet well opening 30 such that sensor support 48 is operably positioned below top 28. In this document "vertical" is used in its usual sense to denote a trajectory along a plumb line. In this document "vertical" is determined with respect to basin 22 with reference to base 24 positioned as the distal most aspect of sump assembly 20, i.e., the aspect of sump assembly 20 most deeply buried in the ground.

Figure 2:
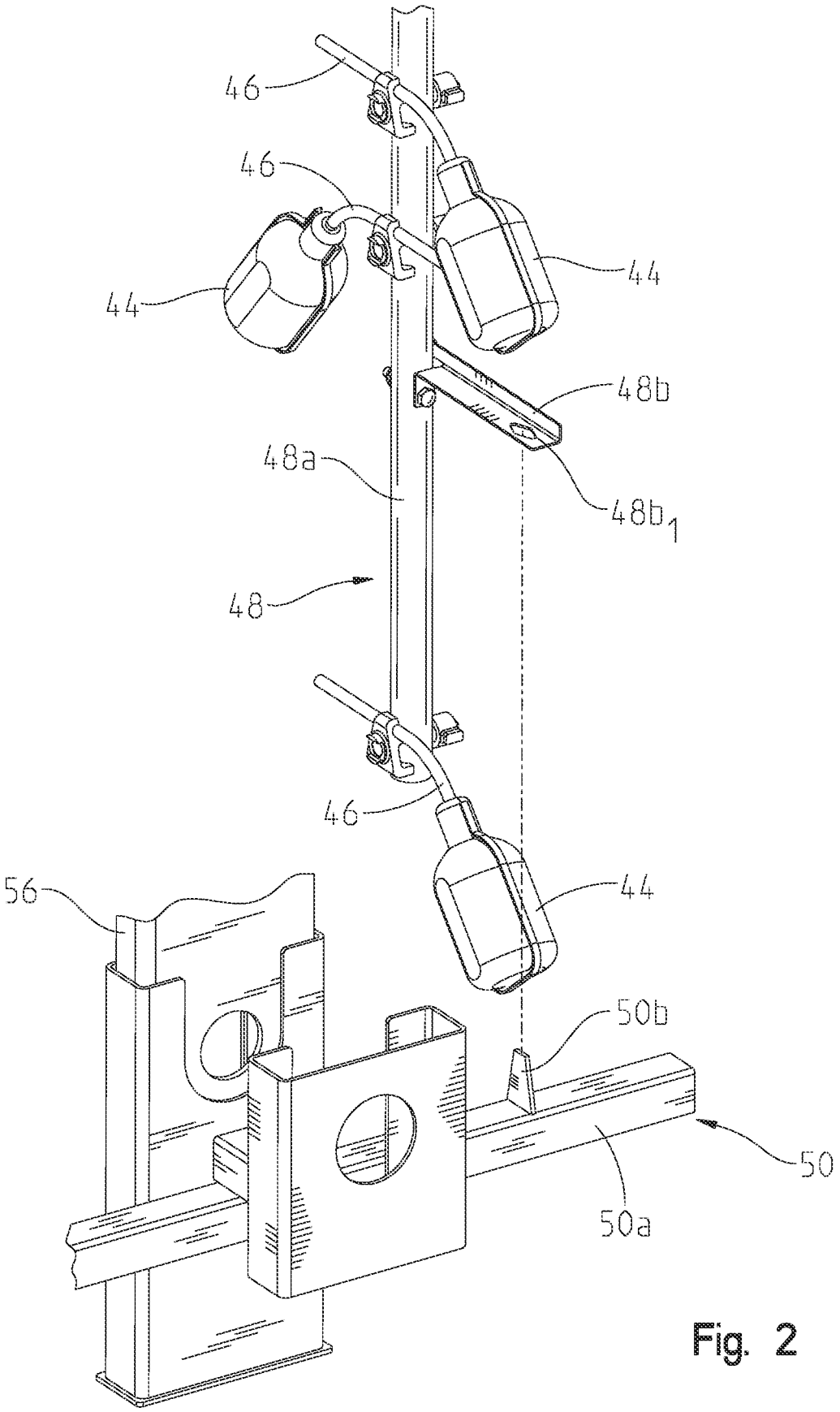
FIG. 2 is a partial, exploded view illustrating a pump control with sensors, in the form of float switches tethered to a sensor support engageable with a distal basin support in accordance with the present disclosure.
Figure 3:
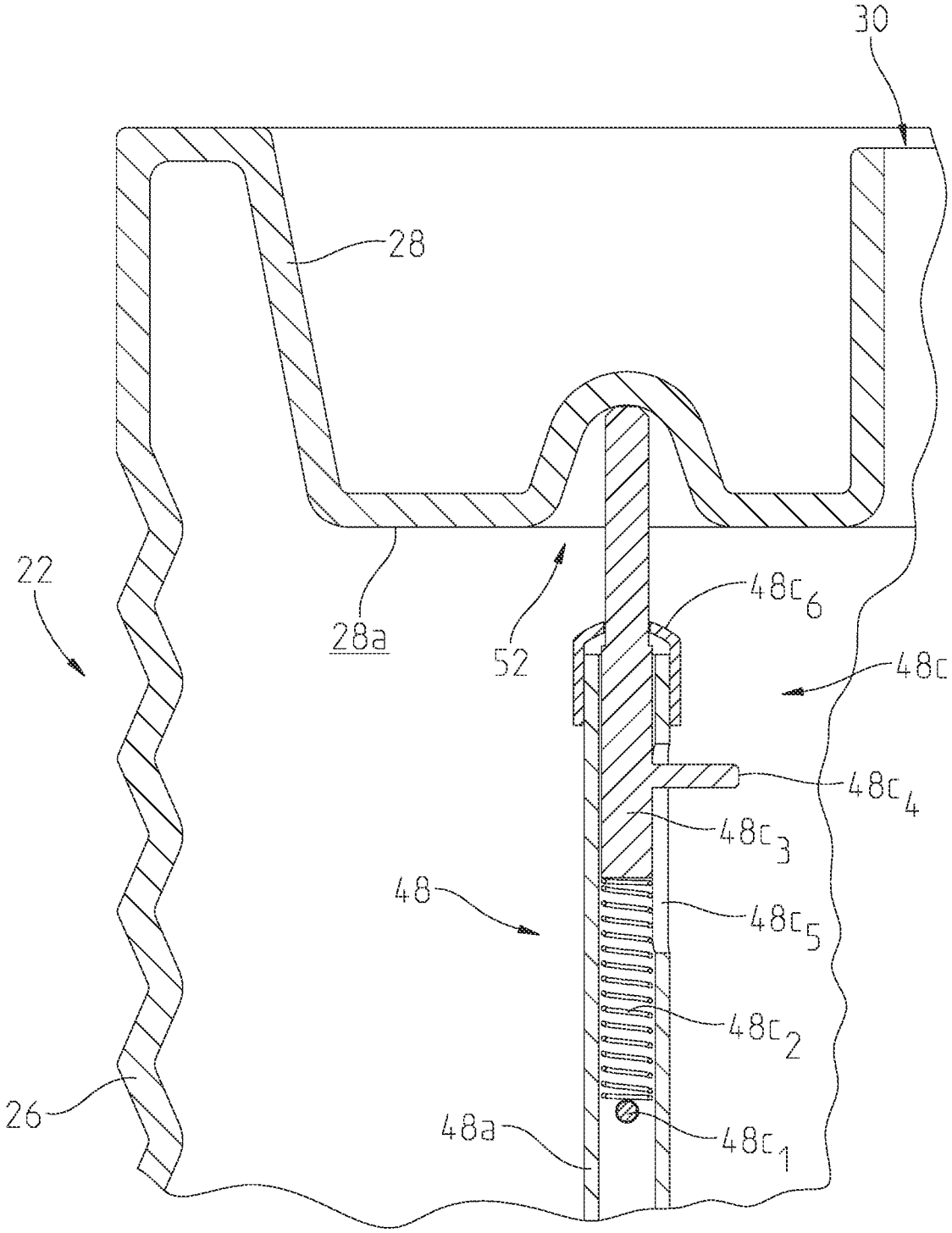
FIG. 3 is a partial, sectional view illustrating a proximal sensor support of the pump control of FIG. 2 engaging a proximal basin support in accordance with the present disclosure.
Figure 4:
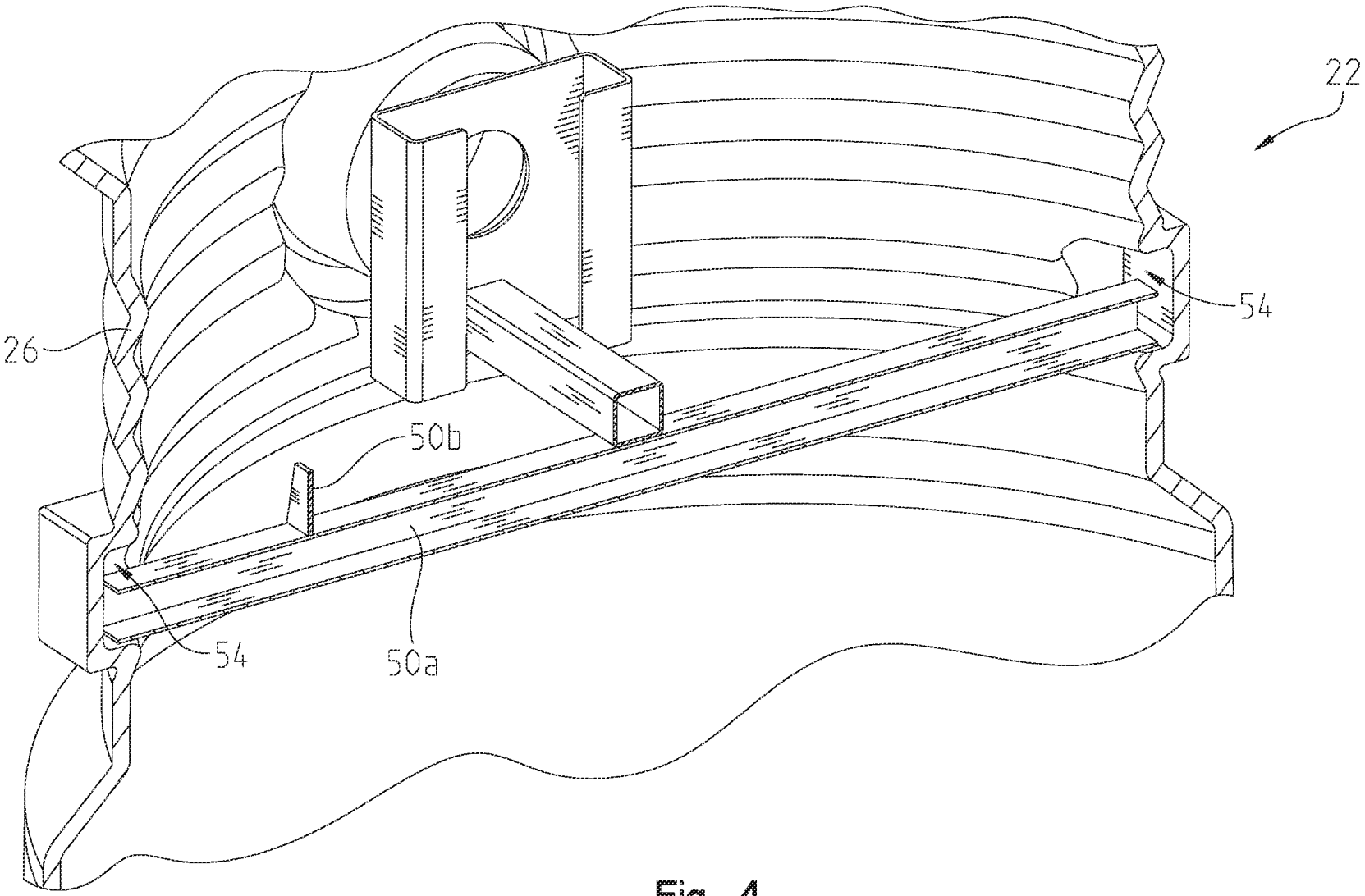
FIG. 4 is a partial, sectional view illustrating in detail the distal basin support of the present disclosure.

Referring to FIGS. 1-3, sensor support 48 includes longitudinal extension 48*a*, distal sensor support 48*b*, and proximal sensor support 48*c*. Basin 22 includes complementary distal basin support 50 and proximal basin support 52. Distal basin support 50 is positioned vertically under top 28 of sump assembly 20 and is vertically covered by top 28 such that distal basin support 50 is not accessible vertically through top 28, i.e., distal basin support 50 cannot be reached along a vertical trajectory from outside basin 22, as such trajectory is intersected by top 28. In the exemplification illustrated, distal basin support 50 is located in the lower half of the vertical extent of basin 22. Distal basin support 50 includes a support in the form of cross beam 50*a* which provides vertical support for sensor support 48 above base 24, i.e., it supports sensor support 48 at a vertical distance from base 24.

Figure 5:
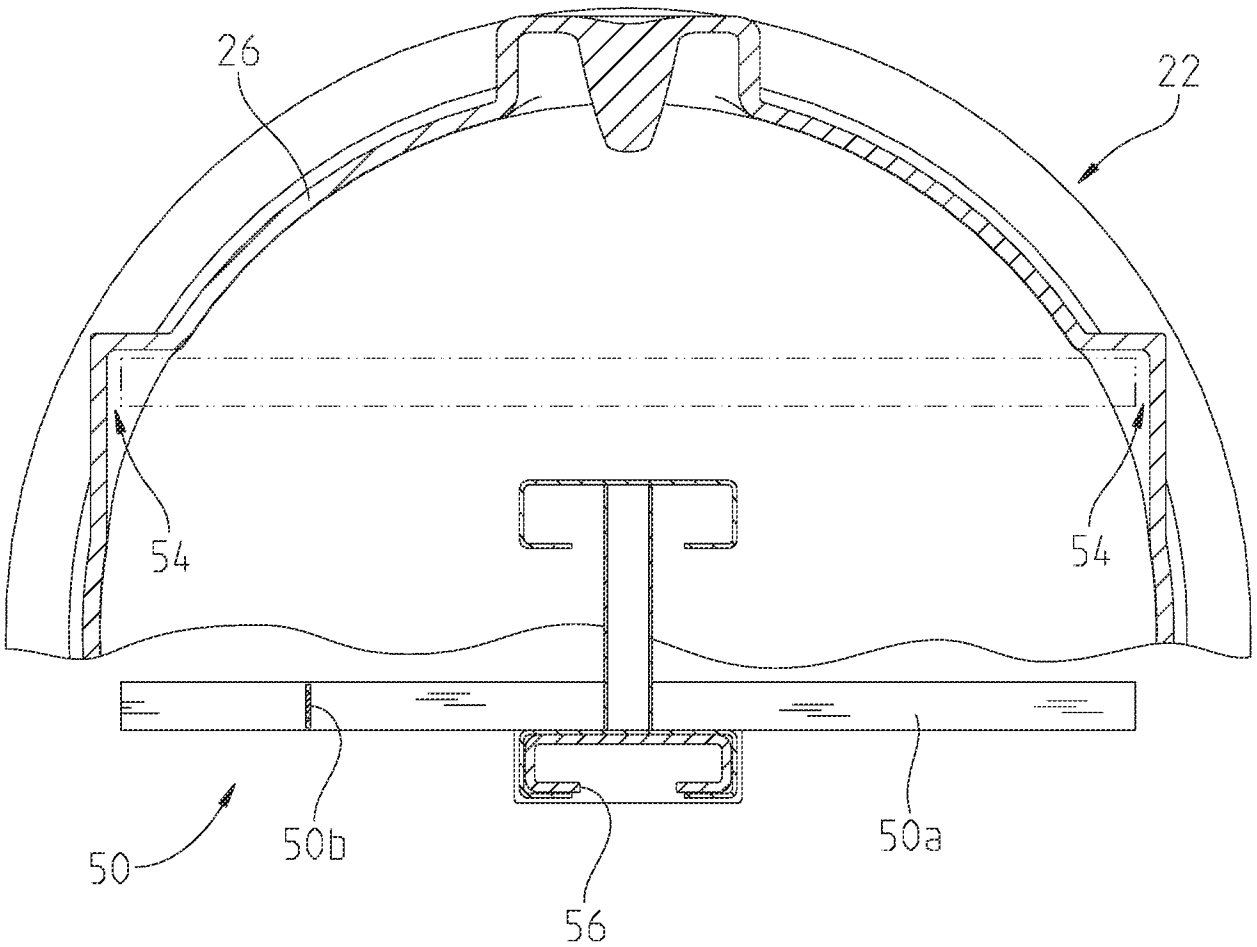
FIG. 5 is a partial, sectional view illustrating assembly of the distal basin support to the basin of the present disclosure.

Upstanding wall 26 of basin 22 includes a pair of recesses 54 sized to receive opposite ends of cross beam 50*a*. Referring to FIG. 5, cross beam 50*a* can be positioned orthogonal to the longitudinal axis of basin 22, owing to the fact that cross beam 50*a* has a length less than the internal diameter of basin 22. From the position illustrated in FIG. 5, cross beam 50*a* can be moved from a central position within basin 22 radially outwardly such that opposite ends of cross beam 50*a* occupy recesses 54 as illustrated in FIGS. 1, 6, 7, 8, and 9. As illustrated, cross beam 50*a* is further secured to C-channel 56 which supports submersible pump 32 and associated outlet piping. When C-channel 56 is secured to basin 22, it retains cross beam 50*a* within recesses 54 to support cross beam 50*a* a vertical distance above base 24.

Cross beam 50*a* features shark fin extension 50*b* extending vertically upward from cross beam 50*a*. Sensor support 48 features distal sensor support 48*b* extending radially outward from longitudinal extension 48*a*. Referring, e.g., to FIGS. 1 and 2, the distal sensor support 48*b* is exemplified as a metallic beam bolted to longitudinal extension 48*a*, which takes the form of a plastic tube such as a PVC pipe. Distal sensor support 48*b* includes aperture $\mathbf{48}b_1$ (FIG. 2) sized to receive shark fin extension 50*b* to index sensor support 48 relative to distal basin support 50. More particularly, with shark fin extension 50*b* received in aperture $\mathbf{48}b_1$, sensor support 48 is restrained from translating horizontally relative to distal basin support 50. However, owing to the size and geometry of aperture $\mathbf{48}b_1$ and shark fin extension 50*b*, sensor support 48 is rotatable about an axis parallel to the longitudinal axis of distal basin support 50 and intersecting shark fin extension 50*b*. This axis of rotation will intersect upstanding wall 26 of basin 22 twice, adjacent to the opposite ends of distal basin support 50. The relative rotation allowed by the interaction of aperture 48$b_1$ and shark fin extension 50*b* also allows sensor support 48 to be engaged with distal basin support 50 in a non-vertical manner. Specifically, sensor support 48 can be inserted through wet well opening 30, as shown in FIG. 6, and shark fin extension 50*b* piloted into aperture 48$b_1$, as shown in FIG. 7, without requiring a vertical orientation of longitudinal extension 48*a*.

Figure 7:
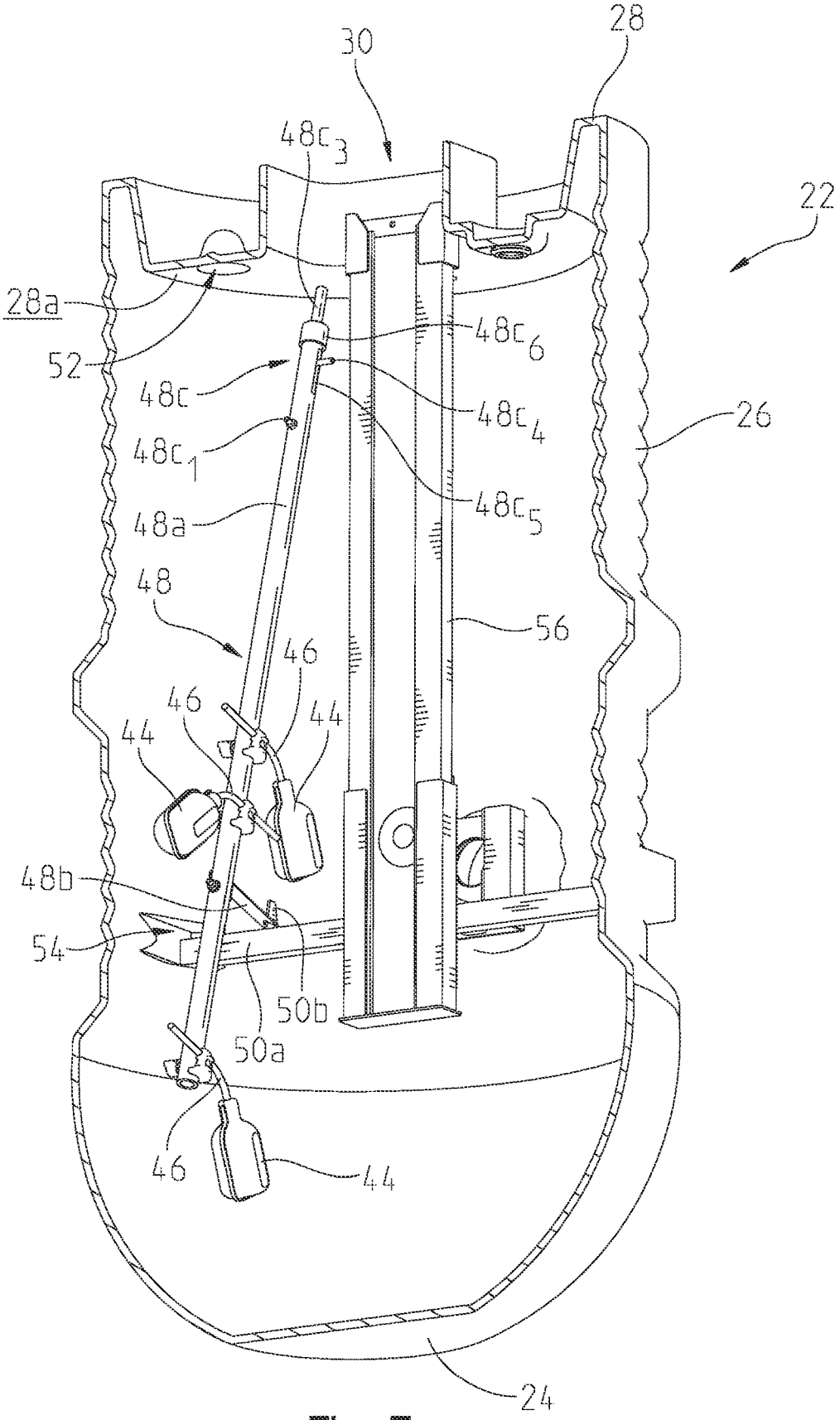
FIG. 7 is a perspective, partial sectional view of the wastewater sump assembly of FIG. 5, illustrating a step of inserting a pump control of the present disclosure into the wastewater assembly subsequent to the step shown in FIG. 6.

With shark fin extension 50*b* occupying aperture 48$b_1$, as illustrated in FIG. 7, sensor support 48 is free to rotate about an axis parallel to the longitudinal axis of distal basin support 50 and intersecting shark fin extension 50*b*; therefore, sensor support 48 is not yet secured against movement to positively retain float switches 44 in their desired positions. From the position illustrated in FIG. 7, sensor support 48 may be rotated into its final secured position illustrated in FIG. 9, with proximal sensor support 48*c* engaging proximal basin support 52.

Figure 10:
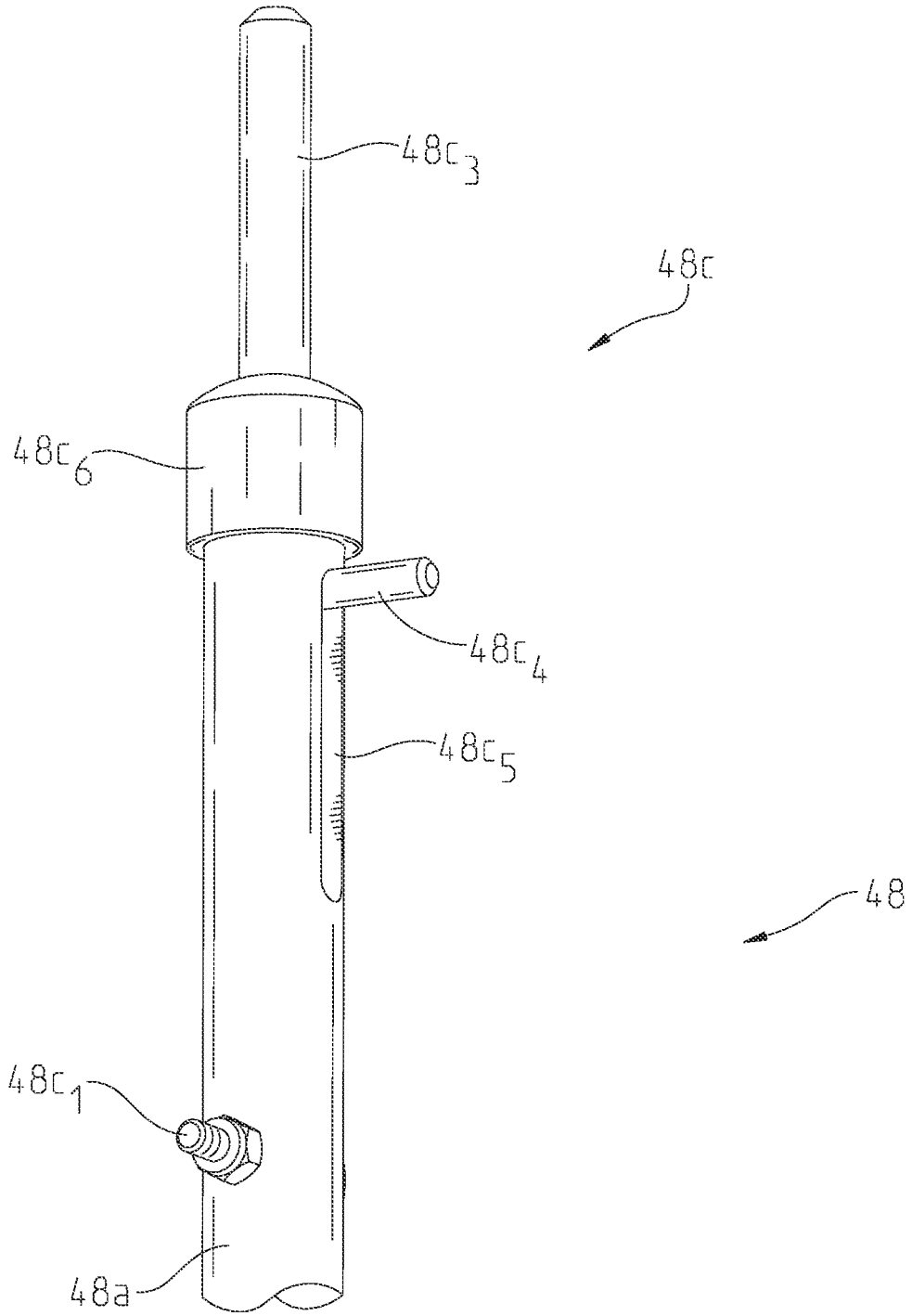
FIG. 10 is a partial perspective view of the proximal sensor support of the present disclosure.

Proximal sensor support 48*c* includes stop pin 48$c_1$ positioned orthogonally through longitudinal extension 48*a* and intersecting the central longitudinal axis of longitudinal extension 48*a*. In the exemplification illustrated, stop pin 48$c_1$ is a bolt that extends through a transverse aperture in longitudinal extension 48*a* and is secured by a nut. Spring 48$c_2$ is positioned within the longitudinal space formed in longitudinal extension 48*a* and positioned atop stop pin 48*c*. Spring pin 48$c_3$ is positioned atop spring 48$c_2$ as illustrated in FIG. 3. Actuator pin 48$c_4$ extends radially outward from spring pin 48$c_3$, occupying longitudinal slot 48$c_5$ formed through the wall of longitudinal extension 48*a* and intersecting the longitudinal space therein. While illustrated as being integral with spring pin 48$c_3$, actuator pin 48$c_4$ may be a separate element threadedly connected to or otherwise (see also FIG. 10) selectively secured to spring pin 48$c_3$. Longitudinal slot 48$c_5$ limits the travel of actuator pin 48$c_4$ and thereby limits the travel of spring pin 48$c_3$. Cap 48$c_6$ may be positioned over and secured to the proximal end of longitudinal extension 48*a* as illustrated in FIG. 3. In embodiments in which actuator pin 48$c_4$ is integrally formed with spring pin 48$c_3$, longitudinal slot 48$c_5$ may intersect the proximal most end of longitudinal extension 48*a* and thereby be open proximally. In such a configuration, cap 48$c_6$ will provide an upper boundary of travel for actuator pin 48$c_4$. In alternative configurations, spring pin 48*c*3 could be replaced by a spring biased ball. Furthermore, while the detent mechanism defined by proximal sensor support 48*c* and proximal basin support 52 incorporates a detent in the basin and a spring biased element in the sensor support, these features of the detent mechanism could be reversed, with the spring biased element extending downwardly from undersurface 28*a* of top 28 of basin 22 to cooperate with a recess formed in the proximal end of sensor support 48.

Figure 8:
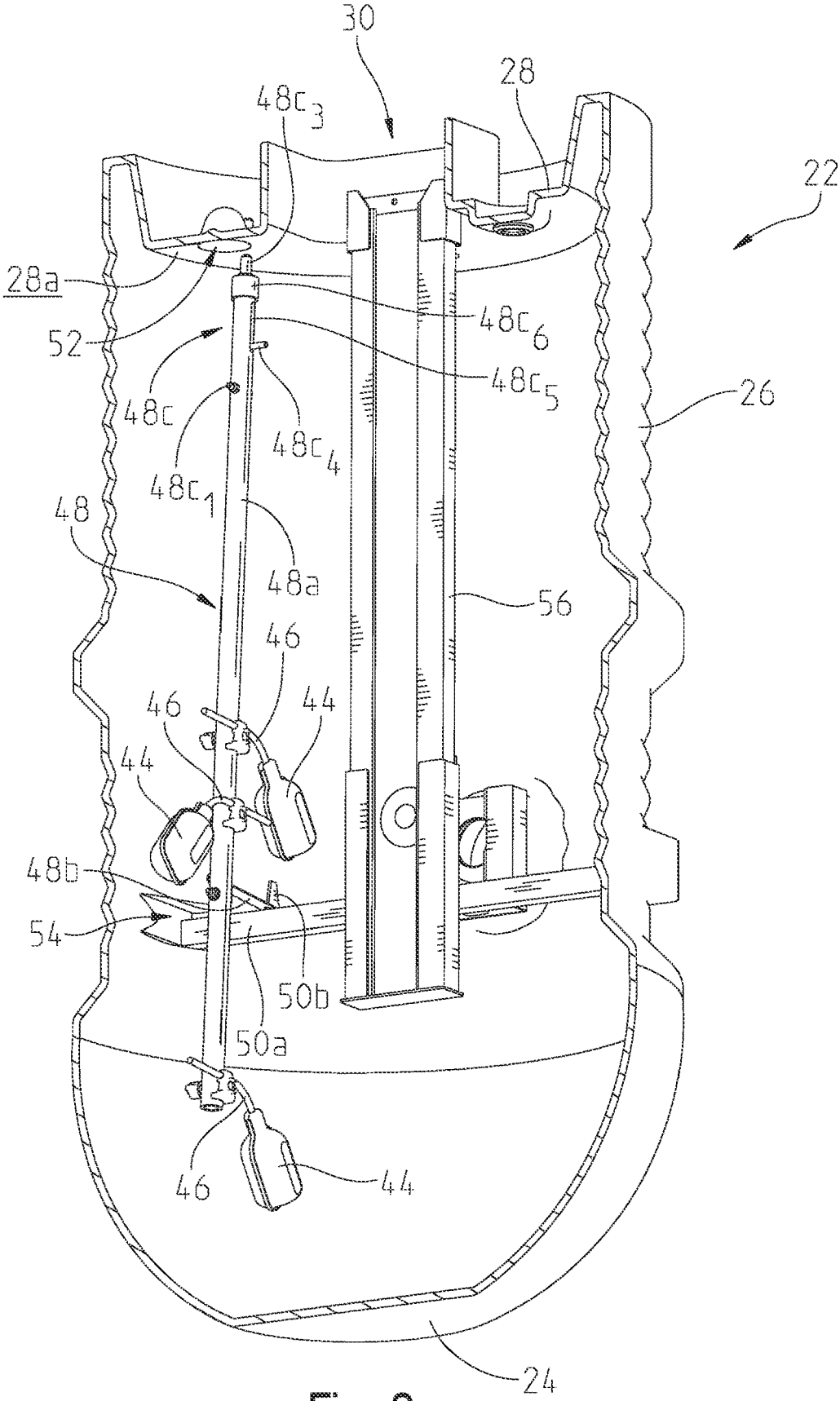
FIG. 8 is a perspective, partial sectional view of the wastewater sump assembly of FIG. 5, illustrating a step of inserting a pump control of the present disclosure into the wastewater assembly subsequent to the step shown in FIG. 7.

From the position illustrated in FIG. 7 (with the proximally terminal end of spring pin 48$c_3$ abutting undersurface 28*a* of top 28), sensor support 48 can be rotated toward the positioned illustrated in FIG. 8, with spring pin 48*c*3 moving distally to compress spring 48$c_2$. From the position illustrated in FIG. 8, sensor support 48 can be further rotated into the position illustrated in FIG. 9, with spring pin 48*c*3 extending proximally from the position illustrated in FIG. 8 to occupy proximal basin support 52. In the illustrated embodiment, proximal basin support 52 defines a recess which cooperates with spring pin 48$c_3$ to define a detent mechanism horizontally indexing sensor support 48 within basin 22 in the installed configuration illustrated in FIG. 9. Stated another way, engagement of proximal sensor support 48*c* with proximal basin support 52 horizontally supports the pump control (in the form of sensor support 48 and depending float switches 44) within the interior volume of basin 22, i.e. engagement of proximal sensor support 48*c* with proximal basin support 52 resists horizontal translation of sensor support 48. In this configuration, sensor support 48 is vertically supported above base 24 of basin 22 by engagement of distal sensor support 48*d* with distal basin support 50 and sensor support 48 is horizontally supported by engagement of proximal sensor support 48*c* with proximal basin support 52 such that sensor support 48 is secured in a defined position within basin 22. In the illustrated embodiment, distal sensor support 48*d* also provides horizontal support to sensor support 48. With the sensor support of the present disclosure, float switches 44 can be suspended within basin 22 without requiring a support vertically accessible through wet well opening 30 and without requiring the sensor support to be positioned through the floor of the dry well.

Figure 9:
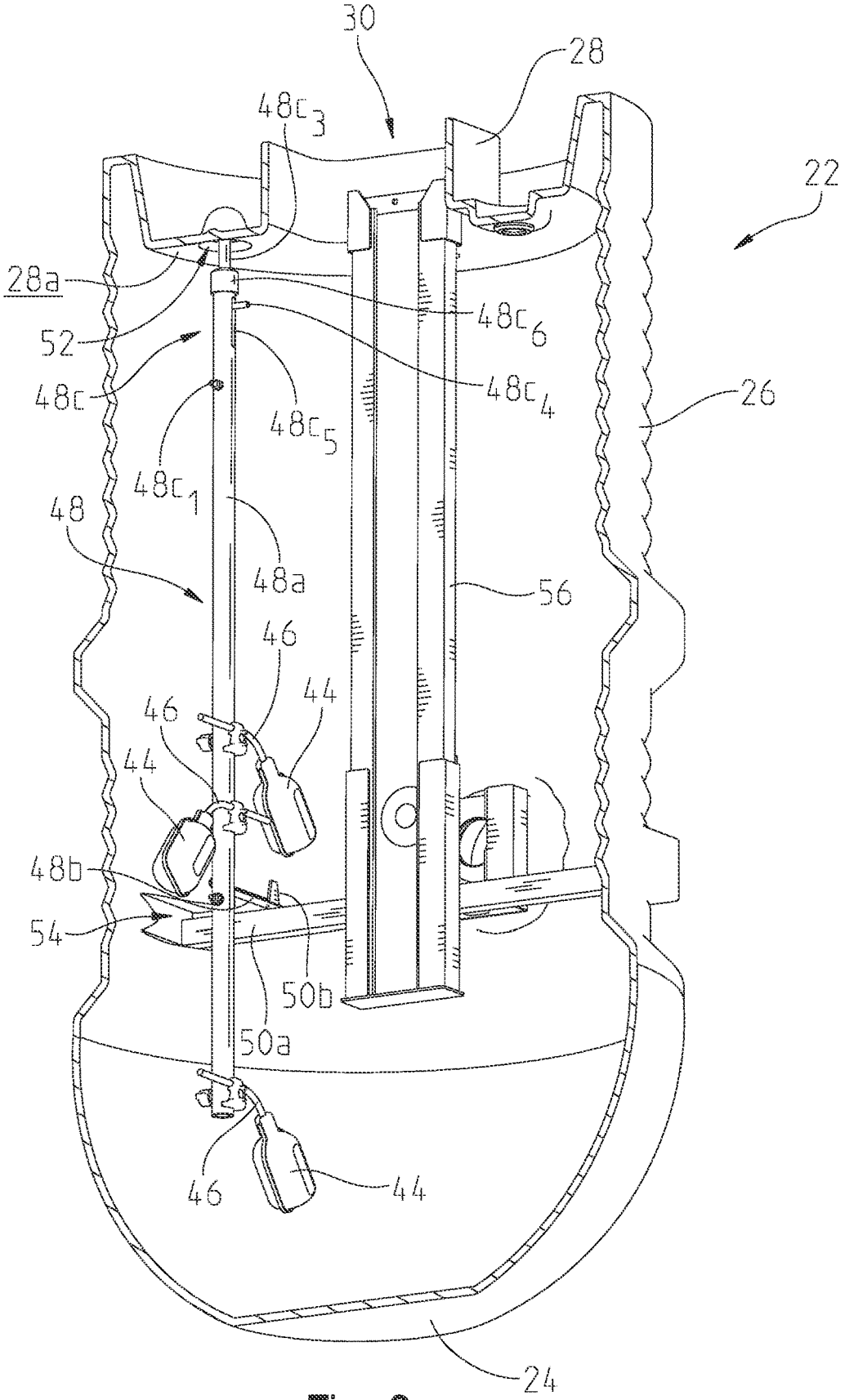
FIG. 9 is a perspective, partial sectional view of the wastewater sump assembly of FIG. 5, illustrating a step of inserting a pump control of the present disclosure into the wastewater assembly subsequent to the step shown in FIG. 8.

In operation of the illustrated embodiment, movement of spring pin 48$c_3$ to allow engagement and disengagement of proximal sensor support 48*c* with proximal basin support 52 can be effected by either manual movement of actuator pin 48$c_4$ or by the automatic interaction between spring pin 48$c_3$ and undersurface 28*a* of top 28 when sensor support 48 is moved between its position illustrated in FIG. 7 and its position illustrated in FIG. 9. In the latter case, actuator pin 48$c_4$ and longitudinal slot 48$c_5$ could be eliminated and, instead, travel of spring pin 48$c_3$ could be limited, for example, by a shoulder on spring pin 48$c_3$ that abuts the underside of cap 48$c_6$. The detent mechanism defined by proximal sensor support 48*c* and proximal basin support 52 and, in particular, spring 48$c_2$, spring pin 48$c_3$, and the recessed defined by proximal basin support 52, can be appropriately designed so that proximal sensor support 48*c* easily disengages with proximal basin support 52 when sensor support 48 is pivoted without using actuator pin 48$c_4$. Therefore, actuator pin 48$c_4$ can be eliminated in alternative embodiments of the present disclosure.

In an alternative methods of assembly, proximal sensor support 48*c* can first be engaged with proximal basin support 52 and distal sensor support 48*b* thereafter engaged with distal basin support 50. In this method of assembly, spring pin 48$c_3$ is inserted into the depression that defines proximal basin support 52. Thereafter, with the technician grasping longitudinal extension 48*a*, spring pin 48$c_3$ is pressed against undersurface 28*a* of top 28 to compress spring 48$c_2$ and allow distal sensor support to be moved into position with shark fin extension 50*b* vertically aligned with aperture 48$b_1$ of distal sensor support 48*b*. From this position, distal sensor support 48*b* can be lowered onto distal basin support 50, with shark fin extension 50*b* occupying aperture 48$b_1$ of distal sensor support 48*b* and spring pin 48$c_3$ occupying proximal basin support 52 to secure sensor support 48 in basin 22 as further described above.

Removal of sensor support 48 from basin 22 can be effected in similar fashion. Specifically, with the technician grasping longitudinal extension 48*a*, spring pin 48$c_3$ is pressed against undersurface 28*a* of top 28 to compress spring 48$c_2$ and allow distal sensor support 48*b* to be raised from abutment with distal basin support 50 while also removing shark fin extension 50*b* from aperture 48$b_1$ of distal sensor support 48*b*. From this position, sensor support 48 can be rotated such that distal sensor support 48*b* is no longer vertically above distal basin support 50 and sensor support 48 can be lowered to remove spring pin 48$c_3$ from proximal basin support 52.

What is claimed is:

1. A pump control comprising:

a sensor operable to communicate a level of wastewater in a container to a pump;

a sensor support, the sensor secured to the sensor support, the sensor support comprising:

a longitudinal extension having a distal end portion and a proximal end portion, with a longitudinal axis extending therebetween;

a distal sensor support arm extending radially outward from the distal end portion of the longitudinal extension relative to the longitudinal axis of the longitudinal extension; and a proximal sensor support comprising a spring pin extending axially along the longitudinal axis and an opening, the spring pin of the proximal sensor support having a terminal end axially moveable relative to the opening along the longitudinal axis to protrude beyond a proximal end surface of the proximal end portion of the longitudinal extension.

2. The pump control of claim 1, wherein said sensor support further comprising a spring providing a biasing force to bias said spring pin away from said distal sensor support arm to a first position, said spring pin actuatable against the biasing force of the spring toward said distal sensor support arm to a second position.

3. The pump control of claim 1, wherein said sensor comprises a float switch tethered to said sensor support.

4. The pump control of claim 1, wherein said sensor comprises a plurality of float switches tethered to said sensor support.

5. The pump control of claim 1, wherein the distal sensor support arm includes an aperture configured to be piloted into engagement with an extension in a sump, and the spring pin being configured to be resiliently engaged with a recess.

6. The pump control of claim 1, wherein said longitudinal extension is an elongate rigid structure.

7. The pump control of claim 1, wherein said distal sensor support arm is an elongate rigid structure.

8. The pump control of claim 2, wherein said spring pin further comprises an actuator pin configured to be manually engaged to actuate said spring pin against the biasing force of the spring.

9. A pump control comprising:

a sensor operable to communicate a level of wastewater in a container to a pump;

a sensor support, comprising:

a longitudinal extension having a distal end portion and a proximal end portion, with a longitudinal axis extending therebetween;

a distal sensor support arm extending radially outward from the distal end portion of the longitudinal extension relative to the longitudinal axis of the longitudinal extension; and a proximal sensor support comprising a spring pin extending axially along the longitudinal axis, the spring pin of the proximal sensor support having a terminal end axially moveable relative to the proximal sensor support along the longitudinal axis to protrude beyond a proximal end surface of the proximal end portion of the longitudinal extensions;

wherein the sensor is attached to the sensor support between the distal end portion and the proximal end portion of the longitudinal extension.

10. A sump pump control, comprising: an extension having a longitudinal axis; a support arm extending radially outward from the extension and including an aperture to receive a portion of a lower support of a basin containing fluid to couple the extension to the lower support; a spring pin positioned within an upper end of the extension for movement along the longitudinal axis between a retracted position permitting the extension to pivot about the portion of the lower support below an undersurface of a top of the basin and an extended position wherein the spring pin engages a recess in the undersurface to position the extension; and at least one sensor attached to the extension and operable to communicate a level of the fluid in the basin to a pump.

* * * * *